US007327976B2

(12) United States Patent
Hamada et al.

(10) Patent No.: US 7,327,976 B2
(45) Date of Patent: Feb. 5, 2008

(54) COLOR IMAGE FORMING APPARATUS

(75) Inventors: Shuta Hamada, deceased, late of Hachioji (JP); by Akira Hamada, legal representative, Hyogo (JP); by Yoshiko Hamada, legal representative, Hyogo (JP); Takenobu Kimura, Hachioji (JP); Yotaro Sato, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 259 days.

(21) Appl. No.: 11/259,708

(22) Filed: Oct. 26, 2005

(65) Prior Publication Data

US 2006/0153601 A1 Jul. 13, 2006

(30) Foreign Application Priority Data

Jan. 11, 2005 (JP) ..... 2005-004079
Jan. 11, 2005 (JP) ..... 2005-004080

(51) Int. Cl.
*G03G 15/16* (2006.01)
*G03G 15/01* (2006.01)
*G03G 15/00* (2006.01)

(52) U.S. Cl. ..... 399/296; 399/49; 399/302

(58) Field of Classification Search ..... 399/296, 399/302, 49
See application file for complete search history.

(56) References Cited

U.S. PATENT DOCUMENTS 6,181,888 B1 * 1/2001 Scheuer et al. ..... 399/49
2006/0051138 A1 * 3/2006 Sato et al. ..... 399/296

FOREIGN PATENT DOCUMENTS

JP 10-274892 10/1998
JP 11-143255 5/1999

* cited by examiner

*Primary Examiner*—Susan Lee
(74) *Attorney, Agent, or Firm*—Cantor Colburn LLP

(57) ABSTRACT

There is disclosed a color image forming apparatus, which makes it possible to prevent a reproduced image from generating image defects, such as a color unevenness, a toner scattering, etc.

7 Claims, 3 Drawing Sheets

COLOR IMAGE FORMING APPARATUS

This application is based on Japanese Patent Application NO. 2005-004079 and NO. 2005-004080, both filed on Jan. 11, 2005 in Japanese Patent Office, the entire contents of which are hereby incorporated by reference.

BACKGROUND OF THE INVENTION

The present invention relates to a color image forming apparatus employing an electro-photographic method.

In general, an image forming method according to an electro-photographic method employed in a color image forming apparatus, such as a copier, printer, etc., includes: forming each of a plurality of primary toner images having different color onto each of a plurality of image bearing members; sequentially transferring each of the unicolor toner images onto an intermediate transfer member to form a full color toner image as primary transferring operation; successively transferring the full color toner image onto a transfer material as a secondary transferring operation; and then, applying a fixing operation to the transfer material to form a final color image.

The electronic potential of the color toner image on the intermediate transfer member varies depending on the attached amount of toner. Accordingly, the secondary transferring condition is normally established at such a value that conforms to the electronic potential of the black toner image in a black solid image. However, it has been a problem that, when a color image having a large amount of attached toner is formed by overlapping a plurality of unicolor toner images, image deficiencies, such as color unevenness and/or a toner scattering, are liable to occur in the final color image as a result of various kinds of transferring errors occurring in the secondary transferring process.

To overcome the abovementioned problem, for instance, there has been proposed such a method that includes: adjusting the electronic potential of the toner layer of the color toner image at a constant potential by applying electronic charge having a polarity same as that of the toner to the color toner image in the secondary transferring preprocessing to be conducted by means of a scorotron charger including a discharging electrode and a grid electrode before the secondary transferring operation; and then, conducting the secondary transferring operation for the adjusted color toner image (for instance, refer to Tokkaihei 10-274892 (Japanese Non-Examined Patent Publication) and Tokkaihei 11-143255 (Japanese Non-Examined Patent Publication).

However, since the electronic potential of the color toner image on the intermediate transfer member varies depending on not only the attached amount of toner, but also an amount of toner charge, it also varies with changes of the using environment and the using condition. Accordingly, the optimum grid voltage to be applied to the grid electrode varies with the electronic potential of the toner layer of the color toner image to be applied the secondary transferring preprocessing. Therefore, since the grid voltage to be applied to the grid electrode is kept constant in the abovementioned conventional method, it is virtually impossible for the method to always create a good condition for conducting the secondary transferring operation for the color toner image.

[Patent Document 1]

Tokkaihei 10-274892 (Japanese Non-Examined Patent Publication)

[Patent Document 2]

Tokkaihei 11-143255 (Japanese Non-Examined Patent Publication)

SUMMARY OF THE INVENTION

To overcome the abovementioned drawbacks in conventional image-recording apparatus, embodiment of the present invention may provide a color image forming apparatus, which makes it possible to prevent a reproduced image from generating image defects, each as a color unevenness, a toner scattering, etc., by establishing a good transferring condition and performing a secondary transferring operation under the established condition, so as to obtain a good color image.

Accordingly, to overcome the cited shortcomings, the abovementioned embodiment of the present invention may be attained by color image forming apparatus described as follows.

(1) A color image forming apparatus, comprising:

a plurality of image bearing members, on which a plurality of unicolor toner images, colors of which are different from each other, are respectively formed through an developing process;

an intermediate transfer member that circularly moves along an array of the plurality of image bearing members, so that the plurality of unicolor toner images are sequentially transferred onto the intermediate transfer member by primary, transferring devices, in such a manner that the plurality of unicolor toner images overlaps with each other at a same position so as to form a full-color toner image on the intermediate transfer member;

a secondary transferring device to transfer the full-color toner image formed on the intermediate transfer member onto a transfer material as a secondary transferring operation;

a discharging device before secondary transfer that is disposed downstream from the array of the plurality of image bearing members and upstream from the secondary transferring device in a moving direction of the intermediate transfer member, and includes a discharging electrode to apply electronic charges having a polarity opposite to that of the full-color toner image to a surface of the intermediate transfer member and a grid electrode to which a voltage having a polarity same as that of the full-color toner image is applied; and a density detecting device to detect a toner density of either at least one of the plurality of unicolor toner images or the full-color toner image, wherein an value of the voltage to be applied to the grid electrode is determined, based on a toner charging amount corresponding value obtained by an output value of the density detecting device.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE PREFERRED EMBODIMENT

Figure 1:
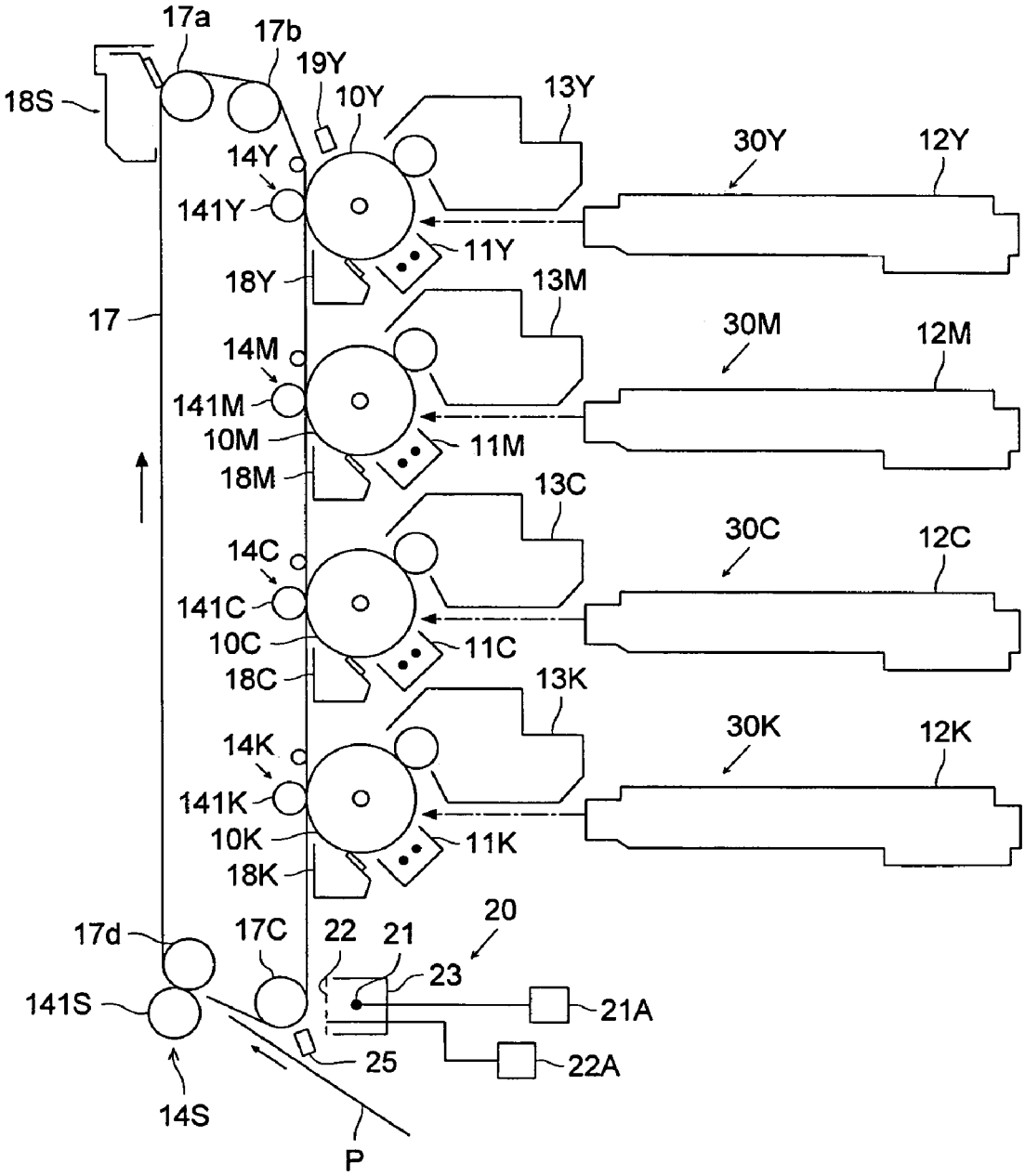
FIG. 1 shows an explanatory schematic diagram of a first embodiment of the color image forming apparatus embodied in the present invention.

Referring to the drawings, an embodiment of the present invention will be detailed in the following.

FIG. 1 shows an explanatory schematic diagram of the first embodiment of the color image forming apparatus embodied in the present invention.

The color image forming apparatus, serving as an image forming apparatus for forming a color image, employs the intermediate transferring method, so to speak, which includes: forming each of a plurality of toner images having different color onto each of a plurality of image bearing members; sequentially transferring each of the unicolor toner images onto a common intermediate transfer member so as to overlap the unicolor toner images with each other on the intermediate transfer member; and then, transferring the full color toner image, formed on the intermediate transfer member, onto a transfer material at a time as a secondary transferring operation.

The color image forming apparatus is provided with an intermediate transfer member 17, which is made of an endless type belt and is circularly moved in a direction indicated by an arrow shown in FIG. 1. In an arranging area of toner image forming units disposed at the outer circumferential region of the intermediate transfer member 17, four toner image forming units 30Y, 30M, 30C, 30K, for forming a yellow toner image, a magenta toner image, a cyan toner image, a black toner image, respectively, are disposed in such a manner that these are arrayed along the moving direction of the intermediate transfer member 17 while sequentially separating from each other. The intermediate transfer member 17 is threaded on various kinds of rollers including intermediate rollers 17*a*, 17*b*, 17*c* and a backup roller 17*d* detailed later, so that the intermediate transfer member 17 is circularly moved while being contacted image bearing members 10Y, 10M, 10C, 10K by pushing actions of primary transferring devices 14Y, 14M, 14C, 14K in the toner image forming units 30Y, 30M, 30C, 30K, respectively.

The intermediate transfer member 17 is made of the endless belt having semiconductivity and surface resistivity in a range of $1\times10^{4}$-$1\times10^{12}$ Ω/□. The surface resistivity is measured by applying a voltage of 100 V for 10, seconds under the environment of room temperature and room humidity (temperature: 20±1° C., humidity: 50±2%) by means of the resistivity measuring instrument (Hiresta IP, manufactured by Yuka Electronic Co.).

It is preferable that the intermediate transfer member 17 is made of polyimide, such as, for instance, a heat curing polyimide, a modification polyimide, etc.

The toner image forming units 30Y for forming a toner image of color Y (Yellow) is provided with an image bearing member 10Y being a photoreceptor drum to be rotated. In the peripheral space along the circumferential surface of the image bearing member 10Y, a charging device 11Y, an exposing device 12Y and a developing device 13Y for developing a yellow toner image by using developing agent for color Y (Yellow) are arranged in a rotating direction of the image bearing member 10Y according to this order. Further, a cleaning device 18Y having a cleaning blade for cleaning the image bearing member is disposed at a downstream side of a primary transferring device 14Y, which is disposed at a downstream position of the developing device 13Y in the rotating direction of image bearing member 10Y.

Further, the density detecting sensor 19Y, for detecting density of the toner image formed on the image bearing member 10Y, is disposed at a position downstream from the developing device 13Y and upstream from the primary transferring device 14Y.

For instance, the image bearing member 10Y is provided with a photosensitive layer, which is coated on a drum-shaped metal base member and is made of a resin material containing an organic photoconductive material. In FIG. 1, the image bearing member 10Y is arranged in such a manner that the longitudinal direction of the photoreceptor drum is extended in a direction perpendicular to the paper surface.

The charging device 11Y includes, for instance, a scorotron charger having a grid electrode and a discharging electrode, while the exposing device 12Y includes, for instance, a laser beam irradiating device.

The developing device 13Y includes a developing sleeve, which rotates and which incorporates a magnet to retain developing agent while rotating, and a voltage applying device (not shown in the drawings) for applying a DC bias voltage and/or an AC bias voltage to a gap between the image bearing member 10Y and the developing sleeve.

Further, specific developing conditions are established for this color image forming apparatus. In concrete, the charging voltage of the charging device 11Y is set at, for instance, −700 V; a maximum exposing voltage of the exposing device 12Y is set at, for instance, −100 V; the developing bias voltage of the developing device 13Y is set at, for instance, such a voltage that the AC bias voltage having a peak voltage of 1.5 kV and a frequency of 4 kHz is overlapped with the DC bias voltage of −600 V.

The primary transferring device 14Y is constituted by a primary transferring roller 141Y that is provided so as to form a primary transferring region in a state of press-contacting the surface of the image bearing member 10Y while putting the intermediate transfer member 17 between them, and a transfer-current supplying device (not shown in the drawings) including, for instance, a constant current source coupled to the primary transferring roller 141Y. The yellow toner image, residing on the image bearing member 10Y, is transferred onto the intermediate transfer member 17 by supplying a primary transferring current outputted from the transfer-current supplying device to the primary transferring roller 141Y. The abovementioned method is called as the contact-transferring method.

The cleaning blade for cleaning the image bearing member, provided in the cleaning device 18Y, is made of an elastic material, such as, for instance, a polyurethane rubber, etc. The base portion of the cleaning blade is supported by a supporting member, while the leading edge portion of the cleaning blade contacts the surface of the image bearing member 10Y. Further, the cleaning blade is extended from the base portion in a counter direction, opposite to the rotating direction of the image bearing member 10Y at the contacting point.

Incidentally, each value of the primary transferring current to be supplied from each of the transfer-current supplying devices equipped in the primary transferring devices 14M, 14C, 14K of the toner image forming units 30M, 30C, 30K is the same as that supplied from the primary transferring device 14Y of the toner image forming unit 30Y for forming the yellow toner image.

The density detecting sensor 19*y* detects density of a toner image residing on the image bearing member 10Y. A photosensor, such as, for instance, IDC (Image Density Control) sensor, etc., can be employed as the density detecting sensor 19*y*.

Each configuration of the toner image forming units 30M, 30C, 30K is the same as that of the toner image forming units 30Y for forming a toner image of color Y (Yellow), except that the developing agent includes each of magenta toner, cyan toner and black toner, instead of yellow toner.

A secondary transferring device 14S is disposed at a position downstream from the toner image forming unit 30K for forming a toner image of color K (Black), which is located at the most downstream position in the moving direction of the intermediate transfer member 17. The secondary transferring device 14S is constituted by a secondary transferring roller 141S that is provided so as to form a secondary transferring region in a state of press-contacting the backup roller 17*d* while putting the intermediate transfer member 17 between them, and a transfer-current supplying device (not shown in the drawings) including, for instance, a constant current source coupled to the secondary transferring roller 141S. The full color toner image, formed on the intermediate transfer member 17, is transferred onto a conveyed transfer material P as the secondary transferring operation by supplying a secondary transferring current outputted from the transfer-current supplying device to the secondary transferring roller 141S. The abovementioned method is called as the contact-transferring method. Incidentally, the toner image forming units 30Y, 30M, 30C, 30K, the intermediate transfer member 17 and the secondary transferring device 14S constitute the color-toner image forming section.

Further, a intermediate transfer member cleaning device 18S, having a cleaning blade for removing non-transferred toner remaining on the intermediate transfer member 17, is disposed at a downstream side of a secondary transferring device 14S in the moving direction of the intermediate transfer member 17.

Accordingly, in the color image forming apparatus embodied in the present invention, a discharging device before secondary transfer 20, being, for instance, a scorotron charger having a grid electrode, is disposed downstream from the primary transferring device 14K, located at the most downstream position in the moving direction of the intermediate transfer member 17, and upstream from the secondary transferring device 14S, so as to oppose to an intermediate roller 17*c* while putting the intermediate transfer member 17 between them.

The discharging device before secondary transfer 20 has a function for applying electronic charge, having a polarity same as that of a toner potential of a color toner image formed on the intermediate transfer member 17, to the color toner image formed, and is constituted by a discharging electrode 21, a grid electrode 22 for controlling electronic potential of the color toner image by regulating an amount of electronic charge to be applied onto the color toner image by the discharging electrode 21 and a support member 23, made of conductive material, for supporting the discharging electrode. 21 and the grid electrode 22.

The grid electrode 22 is disposed in such a manner that the grid electrode 22 opposes to the surface of the intermediate transfer member 17 while being apart from the surface with a gap of, for instance, 1 mm.

The electronic potential of support member 23 is kept at the same potential of the grid electrode 22, while the electronic potential of the intermediate roller 17*c* is kept at ground potential.

A discharge voltage applying device 21A applies a bias voltage, a polarity of which is opposite to that of the toner potential of the color toner image, to the discharging electrode 21, while a discharge voltage applying device 22A applies a bias voltage, a polarity of which is opposite to that of the voltage to be applied by the discharging electrode 21, namely, same as that of the toner potential, to the grid electrode 22.

The value of the bias voltage to be applied to the discharging electrode 21 is, for instance, in a range of +4-+6 kV, when the toner included in the color toner image has a negative charging characteristic.

Further, the value of the grid voltage to be applied to the grid electrode 22 is determined on the basis of the toner charging amount corresponding value y, which is derived from an output value Va (hereinafter, also referred to as an output value Va of the density detecting device) being an average value of detecting values of Va1-Va4, each of which is detected by each of the density detecting sensors 19Y, 19M, 19C, 19K disposed corresponding to each of the image bearing members 10Y, 10M, 10C, 10K.

For instance, when an established developing condition is the aforementioned specific developing condition, the value of the grid voltage Vg to be applied to the grid electrode 22 in the discharging device before secondary transfer 20 is determined so as to fulfill the specific equation 1 in the relationship with the output value Va of the density detecting device.

$$Vg(V)=-202.70\ Va+744.78 \quad (1)$$

In concrete, by the output value Va of the density detecting device and a calibration curve (Va=0.0185x+4092) of toner charging amount x, which is obtained under the specific conditions and inherent to the color image forming apparatus concerned, the output value Va of the density detecting device is converted to the toner charging amount x, and then, the toner charging amount corresponding value y is selected corresponding to the toner charging amount x.

Figure 2:
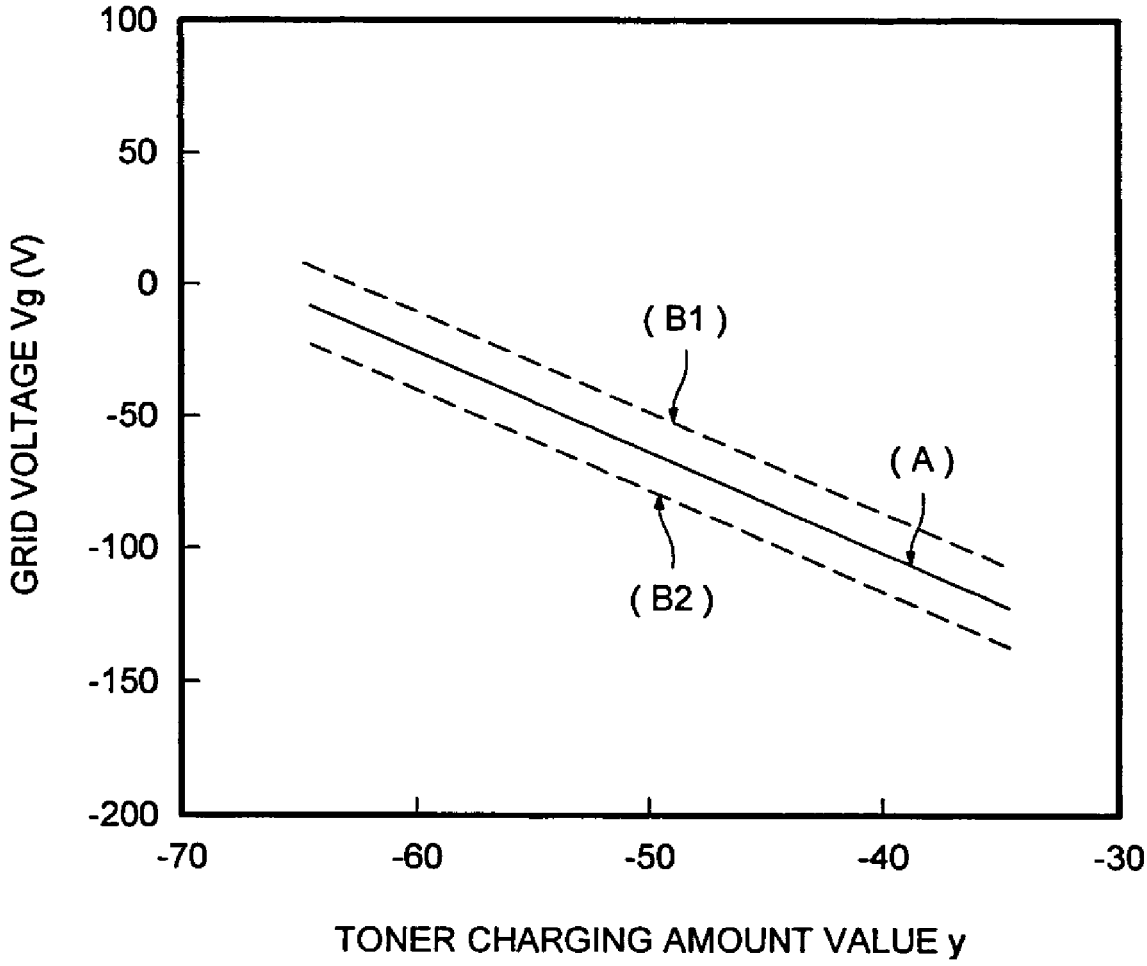
FIG. 2 shows a graph indicating equation (A) and equation (B)

Further, the value of the grid voltage Vg to be applied to the grid electrode 22 is determined by employing the output value Va of the density detecting device and the calibration curve (Va=0.0185x+4092) (shown by (A) in FIG. 2) of toner charging amount x, which is obtained under the specific developing condition established.

In FIG. 2, the vertical axis indicates "the value of the grid voltage Vg", while the horizontal axis indicates "the toner charging amount corresponding value y".

<Toner>

It is preferable that a mass average particle size of the toner to be employed in the color image forming apparatus aforementioned is in a range of 4-7 μm. By employing the toner having the mass average particle size in a range of 4-7 μm, it becomes possible to reduce such toner that have an excessive adhesive property or a weak adhesive force for the transfer material P, resulting in a long time stability of the developing efficiency. Further, since the high transferring efficiency can be achieved, it also becomes possible not only to improve the image quality of a halftone image area, but also to form a visual image in which the image quality of fine lines and that of dots are improved.

Incidentally, hereinafter, the mass average particle size of the toner is measured by employing the "Coulter Counter TA II" or the "Coulter Multi-sizer" (both manufactured by Coulter Co.).

The abovementioned toner is obtained by polymerizing the polymerization monomer in the water-type agent. For instance, fine polymerized particles are manufactured by employing an emulsion polymerization method or by emulsion-polymerizing the monomer in the liquid including emulsion liquid being a necessary addition agent, and then, the abovementioned toner are manufactured by employing the method of adding and associating an organic solvent, a flocculant, etc. Further, the abovementioned toner can be also manufactured by employing the method of mixing and associating a releasing agent, a coloring agent, etc., being necessary constituents of the toner, with the monomer, or by employing the method of dispersing constituents of the toner, such as the releasing agent, the coloring agent, etc., into the monomer, and then, emulsion-polymerizing them, etc. Incidentally, the term of "association" means that a plurality of resin particles and a plurality of coloring agent particles fuse into each other. Further, the water-type agent, defined in the present invention, contains water at least 50%-by-mass.

An example of such the method for manufacturing the toner includes: adding various kinds of constituents, such as the coloring agent, the releasing agent, the charge controlling agent, the polymerizing initiation agent, etc., as needed, into the polymerization monomer; dissolving or dispersing the various kinds of constituents into the polymerization monomer by using a homogenizer, a sand mill, a sand grinder, an ultrasound dispersing machine, etc.; dispersing the polymerization monomer, in which the various kinds of constituents are dissolved or dispersed, in the water-type agent including a dispersing stabilizer into oil particles each of which has a desired dimension as a toner particle; heating them in a reacting apparatus, whose stirring mechanism has the stirring wings detailed later, to accelerate the polymerizing reaction; and after the polymerizing reaction is completed, adjusting the toner by removing the dispersing stabilizer, by filtering, by washing, and further, by drying.

It is preferable that the sphericity of the toner mentioned in the above is in a range of 0.94-0.98. The sphericity of the toner is calculated by employing the following equation 2, after analyzing the 500 toner-particle images, which are randomly sampled from toner particle images magnified 500 hundred times by the scanning type electronic microscope (SEM), by employing the Scanning Image Analyzer (manufactured by Japan Electronic Co. Ltd.).

$$\text{Sphericity} = \text{circumferential length of a circle derived from circle equivalent diameter} / \text{circumferential length of a projected particle image} \quad (2)$$

As for the toner whose sphericity is lower than 0.94, the unevenness of the particles are getting large. Accordingly, such the toner are liable to be destructed, and since the toner particle are not uniformly charged in each of the developing devices 13Y, 13M, 13C, 13K, it is impossible to form a good visual image. On the other hand, as for the toner whose sphericity is greater than 0.98, the cleaning efficiency is getting deteriorated, since the each particle is getting close to the true sphere.

In the color image forming apparatus embodied in the present invention, by employing the developing agent, which includes the small-sized spherical toner manufactured by the aforementioned method and whose shape fulfill the specific condition, it becomes possible not only to improve the image quality of a halftone image area, but also to form a visual image in which the image quality of fine lines and that of dots are improved.

The aforementioned toner can be employed for either one component developing agent or two component developing agent.

When employed for one component developing agent, the non-magnetized one component developing agent, or the magnetized one component developing agent, in which magnetic particles in a range of 0.1-0.5 μm are included with toner, can be cited as an applicable example.

When employed for two component developing agent mixed with carrier, materials, such as an iron, a ferrite, a magnetite, an alloy of these metal and aluminum, an alloy of these metal and lead, etc., can be conventionally and preferably employed as the magnetic carrier particles, and specifically, the ferrite particles are preferable. It is preferable that the mass average particle diameter of the abovementioned magnetic carrier particles is in a range of 15-100 μm, and more preferable, in a range of 25-80 μm. The mass average particle diameter of the carrier particles can be measured by employing the laser diffraction sensor HELOS (manufactured by Sympatec Co. Ltd.) as a representative measuring instrument provided with a wet dispersing unit.

In the color image forming apparatus, the image forming operations are conducted as follow.

In each of the toner image forming units 30Y, 30M, 30C, 30K, each of the image bearing member 10Y, 10M, 10C, 10K is driven to rotate. Under a specific condition, each of the image bearing members 10Y, 10M, 10C, 10K is charged at a predetermined polarity, for instance, a negative polarity, by the charging device 11Y, 11M, 11C, 11K. Next, on an image forming area of the surface of each image bearing member on which a toner image is to be formed, an electronic potential of an irradiated portion (an exposed region) is lowered by an exposing action performed by each of the exposing device 12Y, 12M, 12C, 12K so as to form an electrostatic latent image corresponding to the original image on each of image bearing members 10Y, 10M, 10C, 10K. Then, the reverse developing operation is performed in such a manner that toner charged at, for instance, a negative polarity, namely, the same as that of the surface potential of each of the image bearing members 10Y, 10M, 10C, 10K, are attached to the electrostatic latent image formed on each of the image bearing members 10Y, 10M, 10C, 10K, to form a unicolor toner image corresponding to each of colors Y, M, C, K.

Further, each of the unicolor toner images is sequentially transferred onto the primary transferring area on the intermediate transfer member 17 by each of the primary transferring device 14Y, 14M, 14C, 14K, so that the unicolor toner images of colors Y, M, C, K overlap with each other to form a full color image on the intermediate transfer member 17.

Then, based on the output value Va of the density detecting device, the toner charging amount corresponding value y is selected by using the calibration curve under the specific developing condition. Successively, the value of the grid voltage Vg to be applied to the grid electrode 22 of the discharging device before secondary transfer 20 is derived from the toner charging amount corresponding value y selected in the above by using the specific equation representing the relationship between the toner charging amount corresponding value y and the grid voltage Vg. Accordingly, the electronic potential of the toner layer of the color toner image formed on the intermediate transfer member 17 can be lowered to a value within a range appropriate to the secondary transferring process.

Then, the color toner image, having the electronic potential of the toner layer adjusted in the abovementioned process, is transferred onto the transfer material P as the secondary transferring operation by applying a transferring voltage, adjusted at an appropriate value by the transfer-voltage supplying device, to the secondary transferring roller 141S of the secondary transferring device 14S. Successively, in the fixing process, a fixing device fixes the color toner image onto the transfer material p, to form a full color image.

In each of the toner image forming units 30Y, 30M, 30C, 30K, non-transferred residual toner, remaining on each of the image bearing-members 10Y, 10M, 10C, 10K after passing through the primary transferring region, are removed by the image bearing member cleaning blade equipped in each of the cleaning devices 18Y, 18M, 18C, 18K.

Further, non-transferred residual toner, remaining on the intermediate transfer member 17 after passing through the second transferring region, are removed by the cleaning blade equipped in the intermediate transfer member cleaning device 18S.

According to the color image forming apparatus mentioned in the above, the toner charging amount corresponding value is determined on the basis of the toner charging amount derived from the toner amount really attached onto each of image bearing members 10Y, 10M, 10C, 10K for forming each toner image. Further, based on the toner charging amount corresponding value determined in the above, namely, based on an attached amount of toner necessary for a color toner image to be formed on the intermediate transfer member, the value of the grid voltage to be applied to the grid electrode 22 is determined. In other words, as a result of adjusting the electronic potential of the toner layer of the color toner image corresponding to the attached amount of toner necessary for forming the color toner image, it becomes possible to make the electronic potential of the toner layer of the color toner image, formed on the intermediate transfer member 17, adjusted at a value in a range appropriate for the secondary transferring operation. Accordingly, irrespective of an amount of attached toner included in the color toner image, it is possible to realize a good transferring condition, resulting in a good color image without having any image defects, such as a color unevenness, a toner scattering, etc.

The abovementioned effect is especially remarkable when a bluish image is formed from the magenta toner image and the cyan toner image.

Although the present invention has been described in the foregoing, the scope of the present invention is not limited to the embodiment disclosed in the above. Disclosed embodiment can be varied by a skilled person without departing from the spirit and scope of the invention.

For instance, the specific developing condition is not limited to one set. It is also applicable that the specific developing condition can be selected from a plurality of specific developing condition sets. In this case, it is needless to say that each of the plurality of specific developing condition sets is provided with the output value Va of the density detecting device and the calibration line of the toner charging amount for selecting the toner charging amount corresponding value y, and the specific equation between the toner charging amount corresponding value y and the grid voltage to be applied to the grid electrode.

Further, for instance, the output value of the density detecting device is not limited to an average value of detected values of the density detecting device, but can be derived from other calculated values similar to the above. For instance, an average value of one—three value(s) selected from the detected values of the density detecting device, a sum total value of one—four value(s) selected from the detected values of the density detecting device or a single value selected from the detected values of the density detecting device would be available for this purpose. In any case, the calibration line between the output value of the density detecting device and the toner charging amount under the specific developing condition is obtained to store it as an inherent property for the color image forming apparatus concerned.

Still further, for instance, the specific equation for finding the grid voltage from the toner charging amount corresponding value is not limited to the aforementioned equation (A) for finding as only one meaning. For instance, as indicated by the equation (B) shown in the following, it is applicable that the grid voltage Vg is defined as a value within a certain range with respect to the toner charging amount corresponding value y.

$$Vg=-3.75y-(252.5\pm15) \quad \text{(B)}$$

In FIG. 2, lines B1 and B2 are defined as follow.

$$Vg=-3.75y-(252.5+15) \quad \text{(B1)}$$

$$Vg=-3.75y-(252.5-15) \quad \text{(B2)}$$

FIRST EMBODIMENTS

The first embodiments, for confirming the effect of the present invention, will be detailed in the following. However, the scope of the present invention is not limited to the first embodiments described in the following.

EMBODIMENTS 1-4, COMPARISON EXAMPLES 1-6

According to the configuration shown in FIG. 1, a color image forming apparatus embodied in the present invention is manufactured. Concrete specifications of the color image forming apparatus (a modified version of the "Sitios 8050", manufactured by Konica Minolta Business Technologies Co. Ltd.) are shown in the following.

(1) The two components developing method is employed for the developing device.

(2) The toner having a negative charging property are employed for the developing agent.

(3) The semiconductor-resin endless belt, made of polyimide, having a surface resistivity of $1\times10^{11}$ Ω/□, a volume resistivity of $1\times10^{8}$ Ω/□ and a circumferential length of 861 mm, is employed as the intermediate transfer member. The tension of the belt is set at 49 N.

(4) The scorotron charger, constituted by the discharging electrode and the grid electrode, is employed as the discharging device before secondary transfer.

(5) The contact transferring method using the secondary transfer roller is employed for the secondary transferring device. The secondary transfer roller is constituted by a conductive core metal, made of stainless steel and formed in a cylindrical shape, and a coated layer, made of semi-conductive silicon rubber in a state of sponge foam, in which carbon material is dispersed, and which is formed on the outer circumferential surface of the conductive core metal. An outer diameter, a resistivity value and an Asker C hardness of the secondary transfer roller are 30 mm, $1\times10^{7}$ Ω and 67°, respectively. The pushing pressure to be applied to the intermediate transfer member by the secondary transfer roller is set at 40 N, while the transferring voltage of 3 kV is applied to the secondary transfer roller by the transferring voltage applying device.

(6) The IDC sensor is employed as the density detecting device.

Further, at a position downstream from the discharging device before secondary transfer 20 and upstream from the secondary transferring device 14S in the moving direction of the intermediate transfer member 17, an electronic potential measuring device 25 is disposed so as to measure the electronic potential of the toner layer after the charged potential control processing before secondary transfer is conducted by the discharging device before secondary transfer 20. The measuring results are indicated in Table 1.

By employing the aforementioned color image forming apparatus, the grid voltages to be applied to the grid electrode are established as shown in Table 1, based on the toner charging amount corresponding value y derived from the output value of the density detecting device, and then, the practical photographing test 1 was conducted. The results are indicated in Table 1.

[Practical Photographing Test]

Under the conditions established as follow, a two-color solid image, including magenta and cyan colors, and an image of fine lines of cyan color were respectively outputted as a single image by employing a color paper (Konicaminolta J Paper, manufactured by Konica Minolta Business Technologies Co. Ltd.) as the transfer material.

Surface potential of the organic photoreceptor at a non-exposed area in each of the toner image forming units: −700V Surface potential of the organic photoreceptor at an exposed area: −100V Developing bias voltage to be applied to the developing device under an environment of low temperature and low humidity (10° C., 20%): DC voltage of −600 V+Ac voltage having a peak-to-peak voltage of 1.5 kV and a frequency of 4 kHz DC bias voltage to be applied to the discharging electrode in the discharging device before secondary transfer: +5 kV With respect to the images obtained in the above, a visual inspection was performed in such a manner that each image was evaluated and categorized into the following ranks.

With respect to the two-color solid image:

Good: no color unevenness was perceptible

Bad: color unevenness was perceptible

With respect to the image of fine lines of cyan color

Good: no toner scattering was perceptible

Bad: toner scattering was perceptible

The results of the evaluations are indicated in Table 1.

As is clear from the results indicated in Table 1, in the color image forming apparatus with respect to the embodiments 1-4, in which an appropriate grid voltage, determined by the aforementioned equation (B) in relation to the density, is applied by the discharging device before secondary transfer (20), it can be understood that, with respect to each of the color images obtained, no color unevenness can be observed in the two-color solid image including magenta and cyan colors, and no image defect, such as the toner scattering, etc., is generated in the image of fine lines.

On the contrary, in the color image forming apparatus with respect to the comparison examples 1-6, in which a grid voltage, having an value deviated from a range determined by the aforementioned equation (B) in relation to the developing current, is applied by the discharging device before secondary transfer (20), it can be supposed that the value of the grid voltage is excessively small, namely, the color toner image is not sufficiently discharged, since the color unevenness can be observed in the blue solid image obtained. Further, it can be also supposed that the value of the grid voltage is excessively large, namely, the color toner image is excessively discharged, since the toner scattering can be observed in the image of fine lines.

Next, referring to FIG. 3, the second embodiment will be detailed in the following.

Figure 3:
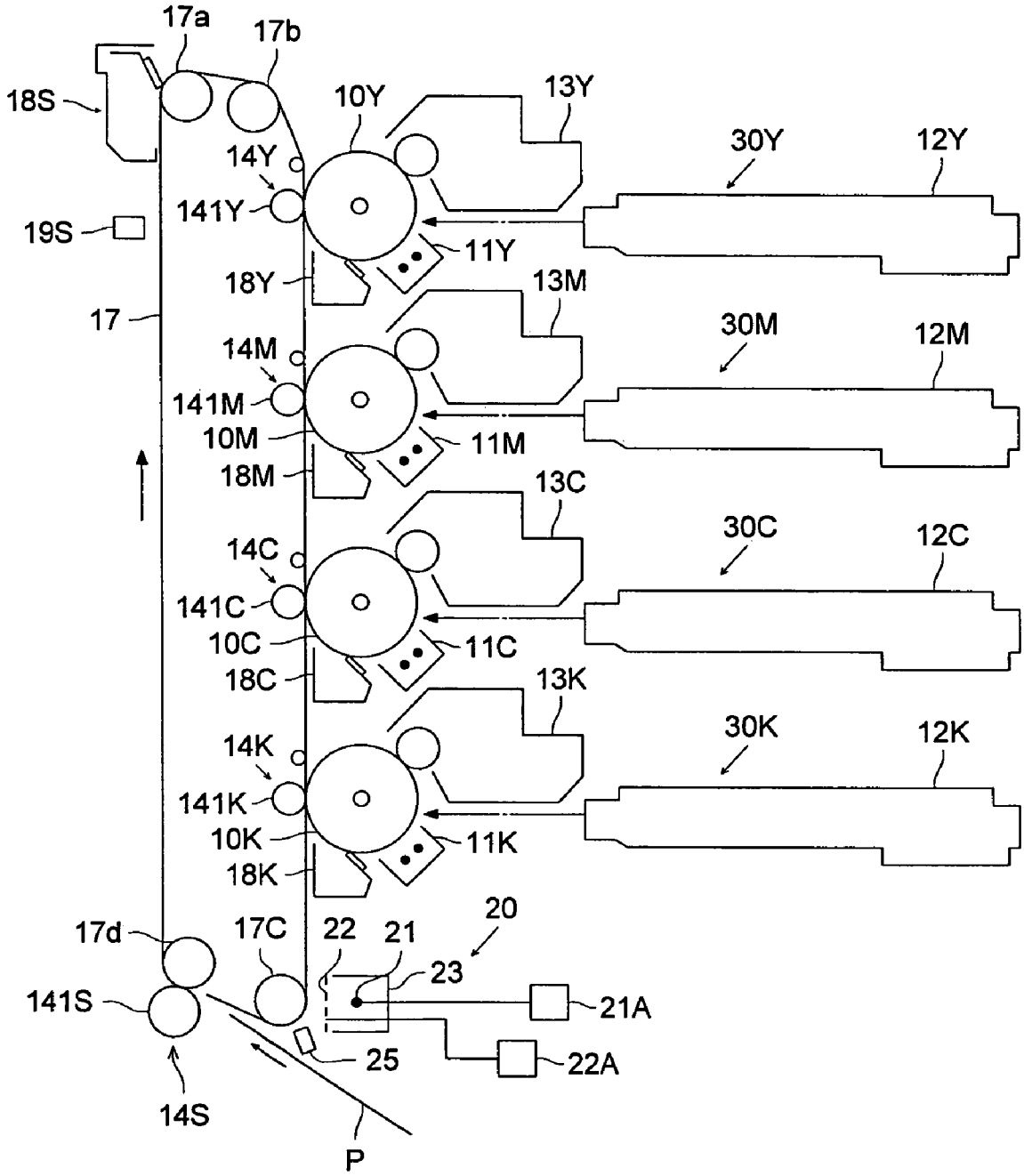
FIG. 3 shows an explanatory schematic diagram of a second embodiment of the color image forming apparatus embodied in the present invention.

As well as the first embodiment shown in FIG. 1, the color image forming apparatus, shown in FIG. 3 and serving as an image forming apparatus for forming a color image, employs the intermediate transferring method, so to speak, which includes: forming each of a plurality of toner images having different color onto each of a plurality of image bearing members; sequentially transferring each of the unicolor toner images onto a common intermediate transfer member so as to overlap the unicolor toner images with each other on the intermediate transfer member, and then, transferring the full color toner image, formed on the intermediate transfer member, onto a transfer material at a time as a secondary transferring operation. Accordingly, the same reference numbers are attached to the structural elements same as those of the first embodiment, and the explanations

TABLE 1

| | Output value Va of the density detecting device (V) | Toner charging amount corresponding value y | Electric potential of the toner layer before discharging | | Grid voltage Vg (V) | Electric potential of the toner layer after discharging | | Evaluation result | | |
|---|---|---|---|---|---|---|---|---|---|---|
| | | | Single layer | Double layer | | Single layer | Double layer | Scattering | Color unevenness | Overall |
| Comparison Example 1 | 4.2 | −40 | −90 | −170 | −50 | −50 | −90 | Bad | Good | Bad |
| Embodiment 1 | | | | | −100 | −90 | −120 | Good | Good | Good |
| Comparison Example 2 | | | | | −150 | −90 | −150 | Good | Bad | Bad |
| Comparison Example 3 | 4.0 | −50 | −100 | −190 | 0 | −50 | −90 | Bad | Good | Bad |
| Embodiment 2 | | | | | −50 | −65 | −110 | Good | Good | Good |
| Embodiment 3 | | | | | −100 | −100 | −125 | Good | Good | Good |
| Comparison Example 4 | | | | | −150 | −100 | −150 | Good | Bad | Bad |
| Comparison Example 5 | 3.8 | −60 | −110 | −210 | 50 | −40 | −90 | Bad | Good | Bad |
| Embodiment 4 | | | | | −50 | −70 | −125 | Good | Good | Good |
| Comparison Example 6 | | | | | −100 | −100 | −145 | Good | Bad | Bad |

for them will be omitted. Only different structural elements and operations will be detailed in the following.

Although, in the first embodiment, each of the density detecting sensors 19Y, 19M, 19C, 19K is provided for each of the toner image forming units 30Y, 30M, 30C, 30K, the density detecting sensors 19Y, 19M, 19C, 19K are removed in the second embodiment.

In concrete, instead of the density detecting sensors 19Y, 19M, 19C, 19K, the density detecting sensors 19S for detecting the color density of the color toner image formed on the intermediate transfer member 17 is disposed at a position downstream from the secondary transferring device 14S and upstream from the intermediate transfer member cleaning device 18S in the moving direction of the intermediate transfer member 17.

The density detecting sensor 19S detects density of a color toner image residing on the intermediate transfer member 17. A photo-sensor that emits diffuse light, such as, for instance, IDC (Image Density Control) sensor, etc., can be employed as the density detecting sensor 19S.

Accordingly, in the color image forming apparatus embodied in the present invention, a discharging device before secondary transfer 20, being, for instance, a scorotron charger having a grid electrode, is disposed downstream from the primary transferring device 14K, located at the most downstream position in the moving direction of the intermediate transfer member 17, and upstream from the secondary transferring device 14S, so as to oppose to an intermediate roller 17*c* while putting the intermediate transfer member 17 between them.

The discharging device before secondary transfer 20 has a function for applying electronic charge, having a polarity same as that of a toner potential of a color toner image formed on the intermediate transfer member 17, to the color toner image formed, and is constituted by a discharging electrode 21, a grid electrode 22 for controlling electronic potential of the color toner image by regulating an amount of electronic charge to be applied onto the color toner image by the discharging electrode 21 and a support member 23, made of conductive material, for supporting the discharging electrode 21 and the grid electrode 22.

The grid electrode 22 is disposed in such a manner that the grid electrode 22 opposes to the surface of the intermediate transfer member 17 while being apart from the surface with a gap of, for instance, 1 mm.

The electronic potential of support member 23 is kept at the same potential of the grid electrode 22, while the electronic potential of the intermediate roller 17*c* is kept at ground potential.

A discharge voltage applying device 21A applies a bias voltage, a polarity of which is opposite to that of the toner potential of the color toner image, to the discharging electrode 21, while a discharge voltage applying device 22A applies a bias voltage, a polarity of which is opposite to that of the voltage to be applied by the discharging electrode 21, namely, same as that of the toner potential, to the grid electrode 22.

The value of the bias voltage to be applied to the discharging electrode 21 is, for instance, in a range of +4-+6 kV, when the toner included in the color toner image has a negative charging characteristic.

Further, the value of the grid voltage to be applied to the grid electrode 22 is determined on the basis of the toner charging amount corresponding value y, which is derived from an value of the primary transferring current to be supplied in the primary transferring region and the output value Va of the density detecting device 19S disposed opposite to the intermediate transfer member 17. Incidentally, the value of the primary transferring current is established as an appropriate value so that the primary transferring operation is conducted at a high transferring rate. For instance, the value of the primary transferring current to be supplied to each of the primary transferring rollers 141Y, 141M, 141C, 141K is set in a range of 15-30 μA.

For instance, when the value of the primary transferring current supplied in each of the primary transferring device 14Y, 14M, 14C, 14K is 20 μA, the value of the grid voltage Vg to be applied to the grid electrode 22 in the discharging device before secondary transfer 20 is determined so as to fulfill the specific equation 2 in the relationship with the output value Va of the density detecting device 19S.

$$Vg(V)=68.18\ Va(V)+156.59 \quad (2)$$

Concretely, by employing the output value Va of the density detecting device 19S and a calibration curve (Va=−0.055x+6) of toner charging amount x, which is obtained when the value of the primary transferring current to be supplied is set at 20 μA and which is inherent to the color image forming apparatus concerned, the output value Va of the density detecting device 19S is converted to the toner charging amount x, and then, the toner charging amount corresponding value y is selected corresponding to the toner charging amount x.

Further, the value of the grid voltage Vg to be applied to the grid electrode 22 is determined by employing the specific equation (A) (Vg=−3.75y−252.5) (shown by (A) in FIG. 2) representing the relationship between the toner charging amount corresponding value y and the value of the grid voltage Vg, both of which are obtained in advance and inherent to the color image forming apparatus concerned.

In FIG. 2, the vertical axis indicates "the value of the grid voltage Vg", while the horizontal axis indicates "the toner charging amount corresponding value y".

In the color image forming apparatus, the image forming operations are conducted as follow.

In each of the toner image forming units 30Y, 30M, 30C, 30K, each of the image bearing member 10Y, 10M, 10C, 10K is driven to rotate. Each of the image bearing members 10Y, 10M, 10C, 10K is charged at a predetermined polarity, for instance, a negative polarity, by the charging device 11Y, 11M, 11C, 11K. Next, on an image forming area of the surface of each image bearing member on which a toner image is to be formed, an electronic potential of an irradiated portion (an exposed region) is lowered by an exposing action performed by each of the exposing device 12Y, 12M, 12C, 12K so as to form an electrostatic latent image corresponding to the original image on each of image bearing members 10Y, 10M, 10C, 10K. Then, the reverse developing operation is performed in such a manner that toner charged at, for instance, a negative polarity, namely, the same as that of the surface potential of each of the image bearing members 10Y, 10M, 10C, 10K, are attached to the electrostatic latent image formed on each of the image bearing members 10Y, 10M, 10C, 10K, to form a unicolor toner image corresponding to each of colors Y, M, C, K.

Further, by supplying the primary transferring current to each primary transferring region of the toner image forming units 30Y, 30M, 30C, 30K, each of the unicolor toner images is sequentially transferred onto the primary transferring area on the intermediate transfer member 17 by each of the primary transferring device 14Y, 14M, 14C, 14K, so that the unicolor toner images of colors Y, M, C, K overlap with each other to form a full color image on the intermediate transfer member 17.

Then, based on the output value Va of the density detecting device 19S, the toner charging amount corresponding value y is selected by using the calibration curve with respect to the value of the primary transferring current supplied to the primary transferring region. Successively, the value of the grid voltage Vg to be applied to the grid electrode 22 of the discharging device before secondary transfer 20 is derived from the toner charging amount corresponding value y selected in the above by using the specific equation representing the relationship between the toner charging amount corresponding value y and the grid voltage Vg. Accordingly, the electronic potential of the toner layer of the color toner image formed on the intermediate transfer member 17 can be lowered to a value within a range appropriate to the secondary transferring process.

Then, the color toner image, having the electronic potential of the toner layer adjusted in the abovementioned process, is transferred onto the transfer material P as the secondary transferring operation by applying a transferring voltage, adjusted at an appropriate value by the transfer-voltage supplying device, to the secondary transferring roller 141S of the secondary transferring device 14S. Successively, in the fixing process, a fixing device fixes the color toner image onto the transfer material p, to form a full color image.

In each of the toner image forming units 30Y, 30M, 30C, 30K, non-transferred residual toner, remaining on each of the image bearing members 10Y, 10M, 10C, 10K after passing through the primary transferring region, are removed by the image bearing member cleaning blade equipped in each of the cleaning devices 18Y, 18M, 18C, 18K.

Further, non-transferred residual toner, remaining on the intermediate transfer member 17 after passing through the second transferring region, are removed by the cleaning blade equipped in the intermediate transfer member cleaning device 18S.

According to the color image forming apparatus mentioned in the above, the toner charging amount corresponding value is determined on the basis of the attached toner amount of the color toner image formed on the intermediate transfer member 17 and the toner charging amount derived from the primary transferring current to be supplied to the primary transferring region. Further, based on the toner charging amount corresponding value determined in the above, namely, based on an amount of toner really attached for forming a color toner image on the intermediate transfer member, the value of the grid voltage to be applied to the grid electrode 22 is determined. In other words, as a result of adjusting the electronic potential of the toner layer of the color toner image corresponding to the attached amount of toner necessary for forming the color toner image, it becomes possible to make the electronic potential of the toner layer of the color toner image, formed on the intermediate transfer member 17, adjusted at a value in a range appropriate for the secondary transferring operation. Accordingly, irrespective of an amount of attached toner included in the color toner image, it is possible to realize a good transferring condition, resulting in a good color image without having any image defects, such as a color unevenness, a toner scattering, etc.

Since the value of the grid voltage is determined on the basis of the toner charging amount corresponding value selected by considering the value of the primary transferring current to be supplied to the primary transferring region, the abovementioned effect is especially effective in such a case that the primary transferring current to be supplied to the primary transferring region concerned is changed.

Further, the abovementioned effect is especially remarkable when a bluish image is formed from the magenta toner image and the cyan toner image.

Although the present invention has been described in the foregoing, the scope of the present invention is not limited to the embodiment disclosed in the above. Disclosed embodiment can be varied by a skilled person without departing from the spirit and scope of the invention.

For instance, when an value of the primary transferring current in each of the toner image forming units is different from each of the other toner image forming units, it is possible to establish any one of an average value of primary transferring currents for one to four toner image forming units selected, a total sum value of primary transferring currents for one to four toner image forming units selected and an value of a primary transferring current of a single toner image forming unit selected as the value for determining the value of the grid voltage.

Still further, for instance, the specific equation for finding the grid voltage from the toner charging amount corresponding value is not limited to the aforementioned equation (A) for finding as only one meaning. For instance, as indicated by the equation (B) shown in the following, it is applicable that the grid voltage Vg is defined as a value within a certain range with respect to the toner charging amount corresponding value y.

$$Vg=-3.75y-(252.5\pm15) \quad (B)$$

In FIG. 2, lines B1 and B2 are defined as follow.

$$Vg=-3.75y-(252.5\pm15) \quad (B1)$$

$$Vg=-3.75y-(252.5-15) \quad (B2)$$

SECOND EMBODIMENTS

The second embodiments, for confirming the effect of the present invention, will be detailed in the following. However, the scope of the present invention is not limited to the second embodiments described in the following.

EMBODIMENTS 5-8, COMPARISON EXAMPLES 7-12

According to the configuration shown in FIG. 3, a color image forming apparatus embodied in the present invention is manufactured. Concrete specifications of the color image forming apparatus (a modified version of the "Sitios 8050", manufactured by Konica Minolta Business Technologies Co. Ltd.) are shown in the following.

(1) The two components developing method is employed for the developing device.

(2) The toner having a negative charging property are employed for the developing agent.

(3) The semiconductor-resin endless belt, made of polyimide, having a surface resistivity of $1\times10^{11}$ Ω/□, a volume resistivity of $1\times10^{8}$ Ω·cm and a circumferential length of 861 mm, is employed as the intermediate transfer member. The tension of the belt is set at 49 N.

(4) The contact transferring method using the primary transfer roller is employed for the primary transferring device. The primary transfer roller is constituted by a conductive core metal, made of stainless steel and formed in a cylindrical shape, and a coated layer, made of semiconductive silicon rubber in a state of sponge foam, in which carbon material is dispersed, and which is formed on the outer circumferential surface of the conductive core metal. An outer diameter, a resistivity value and an Asker C hardness of the primary transfer roller are 20 mm, $1\times10^6$ Ω and 25°, respectively. The pushing pressure to be applied to the image bearing member by the primary transfer roller is set at 4.9 N, while the current value to be supplied to the primary transferring roller is set at 20 μA.

(5) The scorotron charger, constituted by the discharging electrode and the grid electrode, is employed as the discharging device before secondary transfer.

(6) The contact transferring method using the secondary transfer roller is employed for the secondary transferring device. The secondary transfer roller is constituted by a conductive core metal, made of stainless steel and formed in a cylindrical shape, and a coated layer, made of semi-conductive silicon rubber in a state of sponge foam, in which carbon material is dispersed, and which is formed on the outer circumferential surface of the conductive core metal. An outer diameter, a resistivity value and an Asker C hardness of the secondary transfer roller are 30 mm, $1\times10^7$ Ω and 67°, respectively. The pushing pressure to be applied to the intermediate transfer member by the secondary transfer roller is set at 40 N, while the transferring voltage of 3 kV is applied to the secondary transfer roller by the transferring voltage applying device.

(7) The IDC sensor is employed as the density detecting device.

Further, at a position downstream from the discharging device before secondary transfer 20 and upstream from the secondary transferring device 14S in the moving direction of the intermediate transfer member 17, an electronic potential measuring device 25 is disposed so as to measure the electronic potential of the toner layer after the charged potential control processing before secondary transfer is conducted by the discharging device before secondary transfer 20. The measuring results are indicated in Table 2.

By employing the aforementioned color image forming apparatus, the grid voltages to be applied to the grid electrode are established as shown in Table 2, based on the toner charging amount corresponding value y derived from the output value of the density detecting device, and then, the practical photographing test 2 was conducted. The results are indicated in Table 2.

[Practical Photographing Test]

Under the conditions established as follow, a two-color solid image, including magenta and cyan colors, and an image of fine lines of cyan color were respectively outputted as a single image by employing a color paper (Konicaminolta J Paper, manufactured by Konica Minolta Business Technologies Co. Ltd.) as the transfer material.

Surface potential of the organic photoreceptor at a non-exposed area in each of the toner image forming units: −700V Surface potential of the organic photoreceptor at an exposed area: −100V Developing bias voltage to be applied to the developing device under an environment of low temperature and low humidity (10° C., 20%): DC voltage of −600 V+Ac voltage having a peak-to-peak voltage of 1.5 kV and a frequency of 4 kHz DC bias voltage to be applied to the discharging electrode in the discharging device before secondary transfer: +5 kV With respect to the images obtained in the above, a visual inspection was performed in such a manner that each image was evaluated and categorized into the following-ranks.

With respect to the two-color solid image:

Good: no color unevenness was perceptible

Bad: color unevenness was perceptible

With respect to the image of fine lines of cyan color

Good: no toner scattering was perceptible

Bad: toner scattering was perceptible

The results of the evaluations are indicated in Table 2.

TABLE 2

| | Output value Va of the density detecting device (V) | Toner charging amount corresponding value y | Electric potential of the toner layer before discharging | | Grid voltage Vg (V) | Electric potential of the toner layer after discharging | | Evaluation result | | |
|---|---|---|---|---|---|---|---|---|---|---|
| | | | Single layer | Double layer | | Single layer | Double layer | Scattering | Color unevenness | Overall |
| Comparison Example 7 | 4.2 | −40 | −90 | −170 | −50 | −50 | −90 | Bad | Good | Bad |
| Embodiment 5 | | | | | −100 | −90 | −120 | Good | Good | Good |
| Comparison Example 8 | | | | | −150 | −90 | −150 | Good | Bad | Bad |
| Comparison Example 9 | 4.0 | −50 | −100 | −190 | 0 | −50 | −90 | Bad | Good | Bad |
| Embodiment 6 | | | | | −50 | −65 | −110 | Good | Good | Good |
| Embodiment 7 | | | | | −100 | −100 | −125 | Good | Good | Good |
| Comparison Example 10 | | | | | −150 | −100 | −150 | Good | Bad | Bad |
| Comparison Example 11 | 3.8 | −60 | −110 | −210 | 50 | −40 | −90 | Bad | Good | Bad |
| Embodiment 8 | | | | | −50 | −70 | −125 | Good | Good | Good |
| Comparison Example 12 | | | | | −100 | −100 | −145 | Good | Bad | Bad |

As is clear from the results indicated in Table 2, in the color image forming apparatus with respect to the embodiments 5-8, in which an appropriate grid voltage, determined by the aforementioned equation (B) in relation to the density, is applied by the discharging device before secondary transfer (20), it can be understood that, with respect to each of the color images obtained, no color unevenness can be observed in the two-color solid image including magenta and cyan colors, and no image defect, such as the toner scattering, etc., is generated in the image of fine lines.

On the contrary, in the color image forming apparatus with respect to the comparison examples 7-12, in which a grid voltage, having an value deviated from a range determined by the aforementioned equation (B) in relation to the developing current, is applied by the discharging device before secondary transfer (20), it can be supposed that the value of the grid voltage is excessively small, namely, the color toner image is not sufficiently discharged, since the color unevenness can be observed in the blue solid image obtained. Further, it can be also supposed that the value of the grid voltage is excessively large, namely, the color toner image is excessively discharged, since the toner scattering can be observed in the image of fine lines.

EMBODIMENTS 9-10

By employing the color image forming apparatus, which are the same as that employed as the embodiment 5 except that the value of the primary transferring current supplied in the primary transferring device is set at a value in a range of 15-30 μA, the grid voltage to be applied to the grid electrode for each of the embodiments 9-10 was established on the basis of the toner charging amount corresponding value determined by the output value of the density detecting device, and then, the practical photographing test same as that for the embodiment 5 was conducted. As a result, with respect to the color images obtained, no color unevenness can be observed in the bluish solid image including magenta and/or cyan colors, and no image defect, such as the toner scattering, etc., is generated in the image of fine lines.

According to the color image forming apparatus embodied in the present invention, since the value of the grid voltage to be applied to the grid electrode is determined on the basis of the toner charging amount corresponding value derived from the density of the toner image formed on the image bearing member in order to adjust the electronic potential of the toner layer of the color toner image formed on the intermediate transfer member, it becomes possible to adjust the electronic potential of the toner layer of the color toner image formed on the intermediate transfer member within a range appropriate for the secondary transferring operation, irrespective of an amount of toner attached for forming the color toner image. Accordingly, it becomes possible to always establish an optimum condition in the secondary transferring operation, resulting in a reproduction of a good color image without generating the color unevenness and/or the toner scattering.

According to the color image forming apparatus embodied in the present invention, since the value of the grid voltage to be applied to the grid electrode is determined on the basis of the value of the primary transferring current to be supplied to the primary transferring region and the toner charging amount corresponding value derived from an amount of toner attached onto the intermediate transfer member for forming the color toner image in order to adjust the electronic potential of the toner layer of the color toner image formed on the intermediate transfer member, it becomes possible to adjust the electronic potential of the toner layer of the color toner image formed on the intermediate transfer member within a range appropriate for the secondary transferring operation, irrespective of an amount of toner attached for forming the color toner image. Accordingly, it becomes possible to always establish an optimum condition in the secondary transferring operation, resulting in a reproduction of a good color image without generating the color unevenness and/or the toner scattering.

While the preferred embodiments of the present invention have been described using specific term, such description is for illustrative purpose only, and it is to be understood that changes and variations may be made without departing from the spirit and scope of the appended claims.

What is claimed is:

1. A color image forming apparatus, comprising:

a plurality of image bearing members, on which a plurality of unicolor toner images, colors of which are different from each other, are respectively formed through a developing process;

an intermediate transfer member that circularly moves along an array of said plurality of image bearing members, so that said plurality of unicolor toner images are sequentially transferred onto said intermediate transfer member by primary transferring devices, in such a manner that said plurality of unicolor toner images overlaps with each other at a same position so as to form a full-color toner image on said intermediate transfer member;

a secondary transferring device to transfer said full-color toner image formed on said intermediate transfer member onto a transfer material as a secondary transferring operation;

a discharging device before secondary transfer that is disposed downstream from said array of said plurality of image bearing members and upstream from said secondary transferring device in a moving direction of said intermediate transfer member, and includes a discharging electrode to apply electronic charges having a polarity opposite to that of said full-color toner image to a surface of said intermediate transfer member and a grid electrode to which a voltage having a polarity same as that of said full-color toner image is applied; and a density detecting device to detect a toner density of either at least one of said plurality of unicolor toner images or said full-color toner image, wherein a value of said voltage to be applied to said grid electrode is determined, based on a toner charging amount corresponding value obtained by an output value of said density detecting device.

2. The apparatus of claim 1, wherein said density detecting device detects said toner density of at least one of said plurality of unicolor toner images formed on said image bearing members.

3. The apparatus of claim 2, wherein said output value of said density detecting device is defined as an average value of all output values of density detecting devices provided for all of said plurality of image bearing members.

4. The apparatus of claim 2, wherein said output value of said density detecting device is defined as an average value of two or three output values of density detecting devices provided for said plurality of image bearing members.

5. The apparatus of claim 2, wherein said output value of said density detecting device is defined as a total sum value of two, three or four output values of density detecting devices provided for said plurality of image bearing members.

6. The apparatus of claim 1, wherein said density detecting device detects said toner density of said full-color toner image formed on said intermediate transfer member; and, wherein the value of said voltage to be applied to said grid electrode is determined, based on a primary transferring current and the toner charging amount corresponding value.

7. The apparatus of claim 6, wherein said output value of said density detecting device is converted to said toner charging amount corresponding value by employing an inherent calibration line obtained when said primary transferring current, having a predetermined value is supplied.

* * * * *